United States Patent [19]

Johansson et al.

[11] 4,213,257

[45] Jul. 22, 1980

[54] SECURING MEMBER FOR WEAR PARTS FOR EARTH-MOVING MACHINES

[75] Inventors: Arne Johansson; Torsten Larsson, both of Karlskoga, Sweden

[73] Assignee: Aktiebolaget Bofors, Bofors, Sweden

[21] Appl. No.: 939,732

[22] Filed: Sep. 5, 1978

[30] Foreign Application Priority Data

Sep. 6, 1977 [SE] Sweden ..... 7709969

[51] Int. Cl.[2] ..... F16B 19/02

[52] U.S. Cl. ..... 37/142 R; 299/92

[58] Field of Search ..... 37/142 R, 142 A; 403/345, 357, 372, 376, 377; 299/92

[56] References Cited

U.S. PATENT DOCUMENTS

| | | | |
|---|---|---|---|
| 2,901,845 | 9/1959 | Whisler, Sr. | 37/142 A |
| 3,015,248 | 1/1962 | Spurlin | 37/142 A |
| 3,019,537 | 2/1962 | Stephenson | 37/142 A |
| 3,223,452 | 12/1965 | Krekeler | 37/142 A X |
| 3,312,004 | 4/1967 | Johnson | 37/142 A |
| 3,669,477 | 6/1972 | Ulich | 403/377 X |
| 3,879,867 | 4/1975 | Ericson et al. | 37/142 A |

*Primary Examiner*—E. H. Eickholt

*Attorney, Agent, or Firm*—Pollock, Vande Sande & Priddy

[57] ABSTRACT

An improved securing member is disclosed for fastening wear parts to a support, in which a resilient body is fastened between two deformable edge members. In use, the securing member is placed between the wearing part and its support, after which one or another of the edge members is deformed in such a manner as to prevent removal of the wear part.

40 Claims, 5 Drawing Figures

SECURING MEMBER FOR WEAR PARTS FOR EARTH-MOVING MACHINES

BACKGROUND OF THE INVENTION

The present invention relates to a securing member for wear parts for earth-moving machines. Such "wear parts" primarily are teeth and exchangeable cutting edges for excavator and loader buckets, scarifier teeth, teeth for dredge cutters. A great number of different types of securing members have been proposed and tried out for this purpose during the course of the years, but most of the types have been abandoned as they have not proved to be entirely reliable, have had poor resistance to wear and other stresses, or have been altogether too much trouble to install or remove.

One of the absolutely best design principles, which is used in very many variants, is a locking wedge consisting of two longitudinal edge parts made of metal, which are held together by an elastic middle part of comparatively hard rubber. Locking wedges of this type are pressed into a through opening where the edge parts will be in contact with both the part which is to be held fast and the main component to which this part is to be secured. The through opening is then made so much smaller than the width of the locking wedge that its middle part of rubber must be compressed to a certain degree. This makes the wedge fit without play. Since the edge parts usually are provided with locking edges of various shapes which coact with other locking edges on the parts secured relative to each other by the wedge, the risk that the wedge will work out of the locking opening is practically eliminated. The locking wedge can moreover easily be removed by knocking it out with the aid of a drift and a sledge hammer. A representative locking wedge of this type is described in the Swedish Pat. No. 333.551, which corresponds to U.S. Pat. No. 3,879,867 issued Apr. 29, 1975 for a Fastening Means For Retaining A Digger Tooth In A Socket.

However, locking wedges of the main type outlined above cannot readily be used when it is desired to insert the securing member along the same path as the one in which it is desired to lock the parts against movement. As a rule, this does not pose any problems, as in most cases, without any disadvantages, the through locking opening can be applied across the locking direction, but in certain cases it may be appropriate, in fact even necessary, to apply the securing member from the same direction as the wear part itself is inserted.

SUMMARY OF THE INVENTION

The present invention relates to just a securing member which is inserted along the same path as the wear part which it is to secure. A characteristic feature of the securing member according to the invention is that although it consists of two edge parts made of metal secured together by a middle part made of elastic material, it is not primarily the elastic middle part which presses the edge parts against the edges of the locking opening and thereby ensures the position of the securing member in the locking opening. Rather, this blocking of the securing member is achieved through a buckling out of at least one of the edge parts. This edge part is made with portions intended to buckle when one end of the edge part is in contact with a counteracting part and the other end is influenced by one or a plurality of heavy blows in the longitudinal direction of the edge part. The intended portions buckle so that a middle portion of the edge part moves away from the other edge part. If the locking wedge opening is then made so that it presents a groove into which the buckled portion of the edge part can be pressed down, extremely good blocking of the locking wedge is obtained. This is especially so when one end of the wedge is braced against one of the components which are to be secured in relation to each other and the other end is buckled down into a groove in the other component and braced against a blocking edge which forms the outward boundary of the previously mentioned groove.

BRIEF DESCRIPTION OF THE DRAWING

The characteristics of the device according to the invention will now be described in more detail with reference to the accompanying figures, and the invention has been defined in the accompanying claims. Thus, it is not limited to the examples of embodiments shown in the figures.

FIG. 2 shows a perspective view of the securing member, while

In FIG. 4 the alternative securing member is shown inserted in its position, but not buckled, and in FIG. 5 it is buckled.

DETAILED DESCRIPTION OF THE PREFERRED EMBODIMENTS

Figure 1:
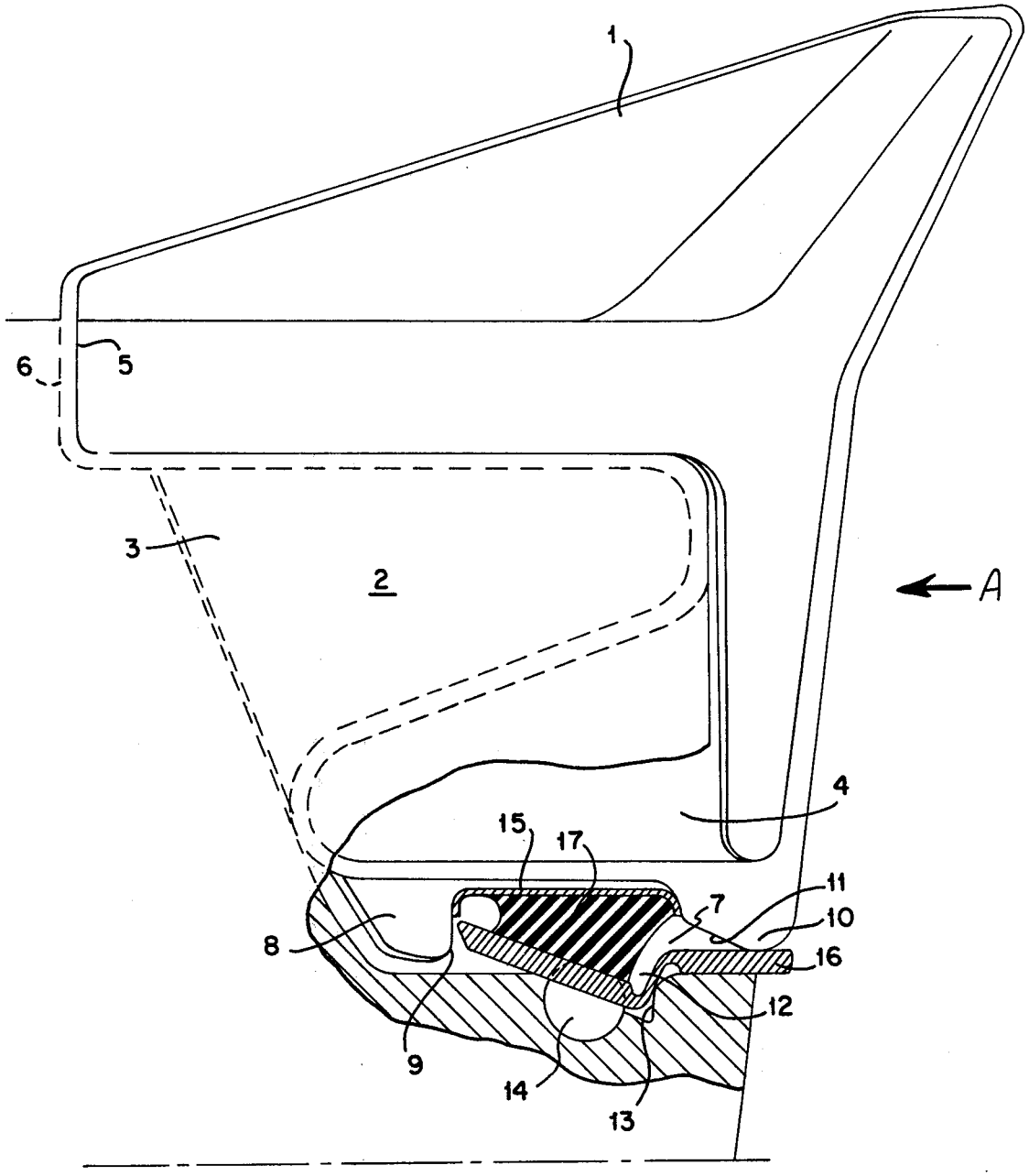
FIG. 1 shows a fragmental view of a cutter tooth in its holder, the holder then having been partly sectioned in order to show how the tooth is blocked in the holder by means of the securing member according to the invention.

In FIG. 1, a cutter tooth 1 is shown inserted in its position in the partly sectioned fragmentally drawn holder 2. The tooth 1 is inserted in its position in the direction indicated by the arrow A and the tooth is removed in the opposite direction. The tooth 1 thus is inserted in a groove in the holder. On both sides of the groove the holder has a bead 3 whichs fits into a corresponding groove in the tooth, while the tooth on both sides has a bead 4 which fits into a groove in the holder. The beads and the grooves and a contact surface between the rear edge 5 of the tooth and the stopping edge 6 of the holder determine the position of the tooth in all directions except the direction of insertion and removal.

On the underside of the tooth, facing the holder, there is an opening 7 into which the securing member can be inserted. In the variant shown in FIGS. 1–3, this opening is delimited at its inner end by a cleat 8 having a stopping edge 9 facing the securing member, and at its outer end by a somewhat lower cleat 10, the inner edge of which to a certain extent is obliquely chamfered at 11.

In the holder 2 there is also arranged an opening 12 opposite opening 7, which is delimited at its outer end by a blocking edge 13. A through hole 14 runs through holder and opening 12, transverse to the longitudinal direction of the opening 7. The upper edge of the hole 14 is at least as high up as to be on a level with the upper edge of the blocking edge 13. Thus, openings 7, 12 define an open-mouthed recess within which the securing member is placed.

The securing member itself comprises two elongated, longitudinal edge members or parts 15, 16, made of metal, which are held together by an elastic middle part or body 17. The joining of the middle part and the two edge parts is achieved by gluing, or in some other known way. The middle part can be made of rubber or some other elastic material. Both of the edge parts have a rectangular cross section. One edge part 15, which can be somewhat thinner than the other edge part 16, preferably has bent ends 18, 19 shaped to fit within opening 7. The other, thicker edge part 16 comprises an elongated portion which extends beyond body 17 toward the mouth of the opening 7 and has two transverse grooves 20, 21, separated axially from each other. Grooves 20, 21 reduce the thickness of edge part 16 and provide buckling locations. Of these grooves, groove 20, nearest the inner end 22 of the edge part 16, is applied on the side of the edge part facing the elastic middle part 17. The groove 20 has a flank 23 located transverse to the inner end 22 of the edge part 16, and a sloping flank which angles upwards so that the groove ends just above a transverse flank 24 of the second groove 21. This second groove 21 is applied on the other side of the edge part 16 with its transverse flank 24 facing the flank 23.

The two grooves 20, 21 thus bound a slightly angled, narrower connecting part which must transmit a force acting on the outer end of the edge part 16. If edge part 16 is compressed in its longitudinal direction, it will buckle, with the result that a portion of edge part 16 will move away from edge part 15 and thereby provide a securing in the longitudinal direction of the member.

Figure 2:
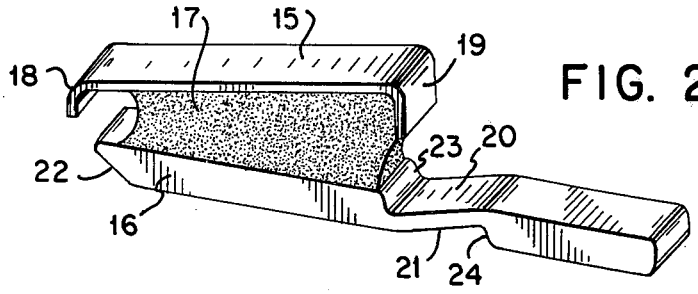
Figure 3:
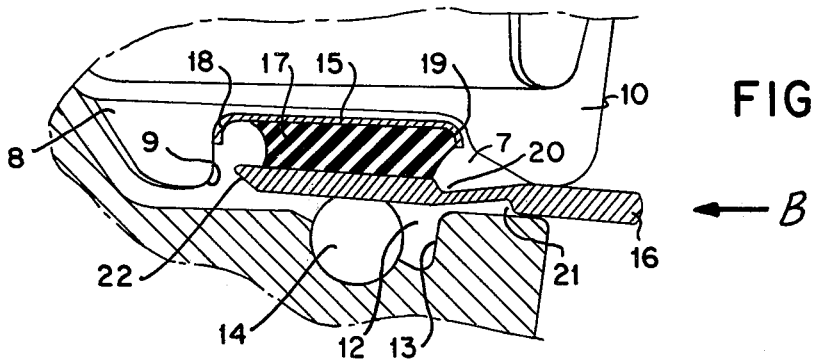
FIG. 3 shows the sectioned part of FIG. 1 with the securing member inserted but not yet buckled.
Figure 5:
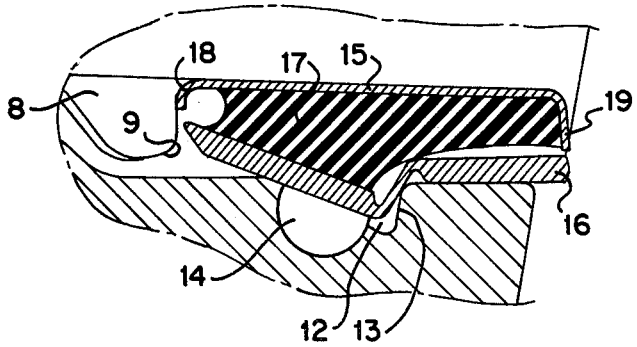

If the distance between the inner end 22 of the edge part 16 and transverse flank 23 of the nearest groove 20 is made somewhat less than the distance between the stopping edge 9 and the blocking edge 13, the buckled configuration shown in FIG. 1 will be obtained when the securing member shown in FIG. 3 is influenced by one or several heavy blows in the direction of the arrow B. The edge part 16 of the securing element will then be forced forwards so that it will come into contact with the stopping edge 9 on the tooth. Squeezed between the stopping edge 9 and the force influencing the outer end of the edge part in the direction of the arrow B, the edge part will be buckled at grooves 20, 21 and will be forced on a level with the first groove 20 away from the other edge part 15 and down into the recess 12, whereby it will come into contact with the blocking edge 13. Thus, the edge part 16 and the grooves 20, 21 cooperate to provide a means for permitting an edge member to buckle into contact with the blocking edge when the edge member is subjected to compressive stress. The obliquely set part of the buckled out edge part 16 between the stopping edge 9 and the blocking edge 13 then provides for very firm securing, at the same time as the elastic middle part 17 of the securing member eliminates any play that might impair the functioning of the tooth. This latter function is best achieved if the middle part is made somewhat wedge shaped, in accordance with the variant shown in FIG. 2. As shown in FIGS. 1 and 5, with a carefully adapted form of the recess 12, combined with apporpriate dimensions of the securing member, the shallow part of the recess 12 will act as a further support point for the buckled out securing member. By forcing a drift through the opening 14, the edge part 16 can be straightened out for removing the tooth and the securing member.

As will be noted from the figures, in the normal case, and when not subjected to any load, the front edge 18 of the edge part 15 appropriately extends somewhat farther out in front of the front edge 22 of the edge part 16. The front edge 22 should moreover preferably be somewhat obliquely chamfered towards the free outer side of the edge part. When the edge part 16 is buckled out by means of one or several heavy blows with a hammer, it will thus first be forced forwards owing to the prestressing of the elastic middle part until its front edge 22 comes into contact with the stopping edge 9 and the buckling out will take place only thereafter. As the elastic middle part 17 strives to resume its original form, the front edge 18 of the edge part 15 will be forced against the stopping edge 9 of the tooth at the same time as the buckled out section of the edge part 16 is forced against the blocking edge 13 of the holder 2. It is thus only at more extreme loads that the stopping edge 9 will be displaced into direct contact with the front edge 22 of the edge part 16, but the movement of the tooth in this direction will then be totally blocked, as the buckled out part of the edge part 16 gives a metallic connection between the cleat 8 made on the tooth and the stopping edge 13 in the holder.

Figure 4:
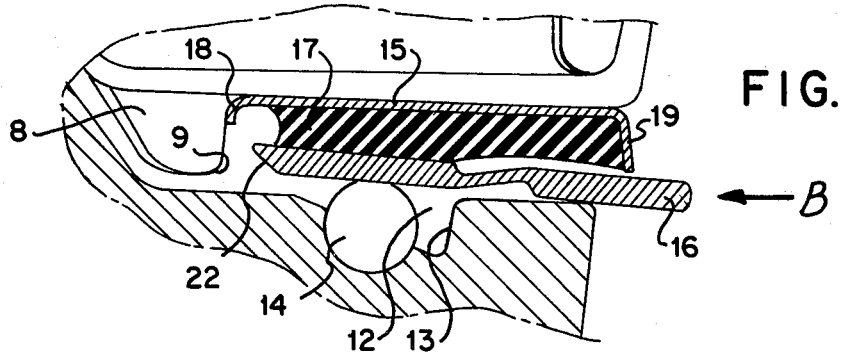
FIGS. 4 and 5 show the sectioned part of FIG. 1, the tooth then, however, having been modified somewhat in order to receive an alternative securing member according to the invention.

FIGS. 1–3 show a variant of the securing member according to the invention in which the elastic middle part 17 ends on a level with the first buckling groove 20. The edge part 15 then also has a length which does not to any major degree exceed the length of the middle part 17. As shown by FIGS. 1 and 3, the tooth 1 is provided with the cleat 10, which defines the outer end of the space for the securing member. Cleat 10 is shaped so that there is space for the edge part 16 between the cleat and the holder. The cleat 10 thereby prevents the outer portion of the edge part 16 from being bent upwards when blows are applied to cause buckling. In the embodiment shown in FIGS. 4 and 5, the elastic middle part 17 and the edge part 15 without buckling grooves extend outwardly to be on a level with the outer edge of the tooth 1. The cleat 10 is omitted, but the outer bent down edge 19 of the edge part 15 has been made so long that it performs the function of the cleat 10 by preventing the outer portion of the locking part from being bent upwards during buckling of the securing member. Thus, the securing member shown in FIGS. 1–3 must be set in place at the same time as the tooth, and it is therefore an advantage to have it joined to the tooth, while the securing member according to FIGS. 4 and 5 is inserted in its place afterwards. The securing member can, for instance, be fastened to the tooth at the factory by means of gluing, or in some other appropriate way.

By making the edge parts 15 and 16 of the securing member with different widths, and in the corresponding way adapting the width of the opening 7 and the recess 12 to these edge parts with different widths, the securing member easily can be prevented from being inserted the wrong way around. This applies particularly to the variant shown in FIGS. 4 and 5.

We claim:

1. Locking apparatus for securing teeth to excavators, loaders, scarifiers, dredge cutters and the like of the type in which each tooth is removably installed in a holder which secures the tooth against movement in all directions except the one from which the tooth is installed and removed, the holder and the tooth defining an open-mouthed recess therebetween within which the locking apparatus can be at least partially placed, the recess having an inner stopping edge located in either the tooth or the holder for limiting movement of the locking apparatus in the direction of installation of the tooth and an outer blocking edge located in either the holder or the tooth for limiting movement of the locking apparatus in the direction of removal of the tooth, said locking apparatus comprising:

a first elongated edge member;

a second elongated edge member;

an elastic body located between and fastened to said first and second edge members; and means provided on at least one of said edge members for permitting said edge member to buckle into contact with the outer blocking edge when said edge member is subjected to compressive stress.

2. Apparatus according to claim 1, wherein said at least one edge member is metal and comprises at one end an elongated portion extending beyond said elastic body toward the mouth of the recess; and said means for permitting buckling comprises a pair of transverse grooves located at axially special locations on opposite sides of said elongated portion.

3. Apparatus according to claim 2, wherein one of said grooves is located on the side of said elongated portion facing said elastic body and is spaced from the other end of said at least one edge member at a distance less than the distance between the inner stopping edge and the outer blocking edge; and the other of said grooves is located on the other side of said elongated portion at a greater distance from said other end.

4. Apparatus according to claim 3, wherein said grooves each comprise a transverse flank extending into said metal toward the other side of said elongated portion and a sloping flank extending from said transverse flank back toward the same side of said portion on which said groove is located, the sloping flank of one groove terminating just opposite the transverse flank of the other groove.

5. Apparatus according to claim 3, wherein only one of said edge members comprises said pair of transverse grooves and the other of said edge members extends at least partially over said elongated portion to limit the movement of said elongated portion during buckling.

6. Apparatus according to claim 3, wherein only one of said edge members comprises said pair of transverse grooves, said one edge member having an inner end facing the inner stopping edge; and the other of said edge members extends beyond said inner end of said one edge member at least when said one edge member is not subjected to a load to induce buckling.

7. Apparatus according to claim 3, wherein said edge members and said elastic body define a wedge shaped unit which tapers toward the inner stopping edge.

8. Apparatus according to claim 3, wherein only one of said edge members comprises said pair of transverse grooves and the other of said edge members and said elastic body extend toward the mouth of the recess only as far as the first of said pair of transverse grooves in said elongated portion.

9. Apparatus according to claim 8, wherein the stopping edge is located in the tooth and the other of said edge members faces a cleat defined by the tooth, the cleat terminating at the mouth of the recess in position to permit said elongated portion to extend at least partially through the mouth of the recess.

10. Apparatus according to claim 4, wherein the sloping flanks of said grooves define therebetween a connecting part of uniform thickness.

11. Apparatus according to claim 4, wherein only one of said edge members comprises said pair of transverse grooves and the other of said edge members extends at least partially over said elongated portion to limit the movement of said elongated portion during buckling.

12. Apparatus according to claim 4, wherein only one of said edge members comprises said pair of transverse grooves, said one edge member having an inner end facing the inner stopping edge; and the other of said edge members extends beyond said inner end of said one edge member at least when said one edge member is not subjected to a load to induce buckling.

13. Apparatus according to claim 4, wherein said edge members and said elastic body define a wedge shaped unit which tapers toward the inner stopping edge.

14. Apparatus according to claim 4, wherein only one of said edge members comprises said pair of transverse grooves and the other of said edge members and said elastic body extend toward the mouth of the recess only as far as the first of said pair of transverse grooves in said elongated portion.

15. Apparatus according to claim 14, wherein the stopping edge is located in the tooth and the other of said edge members faces a cleat defined by the tooth, the cleat terminating at the mouth of the recess in position to permit said elongated portion to extend at least partially through the mouth of the recess.

16. Apparatus according to claim 10, wherein only one of said edge members comprises said pair of transverse grooves and the other of said edge members extends at least partially over said elongated portion to limit the movement of said elongated portion during buckling.

17. Apparatus according to claim 10, wherein only one of said edge members comprises said pair of transverse grooves, said one edge member having an inner end facing the inner stopping edge; and the other of said edge members extends beyond said inner end of said one edge member at least when said one edge member is not subjected to a load to induce buckling.

18. Apparatus according to claim 10, wherein said edge members and said elastic body define a wedge shaped unit which tapers toward the inner stopping edge.

19. Apparatus according to claim 10, wherein only one of said edge members comprises said pair of transverse grooves and the other of said edge members and said elastic body extend toward the mouth of the recess only as far as the first of said pair of transverse grooves in said elongated portion.

20. Apparatus according to claim 19, wherein the stopping edge is located in the tooth and the other of said edge members faces a cleat defined by the tooth, the cleat terminating at the mouth of the recess in position to permit said elongated portion to extend at least partially through the mouth of the recess.

21. Apparatus according to claim 2, wherein only one of said edge members comprises said pair of transverse grooves and the other of said edge members extends at least partially over said elongated portion to limit the movement of said elongated portion during buckling.

22. Apparatus according to claim 21, wherein only one of said edge members comprises said pair of transverse grooves, said one edge member having an inner end facing the inner stopping edge; and the other of said edge members extends beyond said inner end of said one edge member at least when said one edge member is not subjected to a load to induce buckling.

23. Apparatus according to claim 21, wherein said edge members and said elastic body define a wedge shaped unit which tapers toward the inner stopping edge.

24. Apparatus according to claim 21, wherein only one of said edge members comprises said pair of transverse grooves and the other of said edge members and said elastic body extend toward the mouth of the recess only as far as the first of said pair of transverse grooves in said elongated portion.

25. Apparatus according to claim 24, wherein the stopping edge is located in the tooth and the other of said edge members faces a cleat defined by the tooth, the cleat terminating at the mouth of the recess in position to permit said elongated portion to extend at least partially through the mouth of the recess.

26. Apparatus according to claim 2, wherein only one of said edge members comprises said pair of transverse grooves, said one edge member having an inner end facing the inner stopping edge; and the other of said edge members extends beyond said inner end of said one edge member at least when said one edge member is not subjected to a load to induce buckling.

27. Apparatus according to claim 26, wherein said edge members and said elastic body define a wedge shaped unit which tapers toward the inner stopping edge.

28. Apparatus according to claim 26, wherein only one of said edge members comprises said pair of transverse grooves and the other of said edge members and said elastic body extend toward the mouth of the recess only as far as the first of said pair of transverse grooves in said elongated portion.

29. Apparatus according to claim 28, wherein the stopping edge is located in the tooth and the other of said edge members faces a cleat defined by the tooth, the cleat terminating at the mouth of the recess in position to permit said elongated portion to extend at least partially through the mouth of the recess.

30. Apparatus according to claim 2, wherein said edge members and said elastic body define a wedge shaped unit which tapers toward the inner stopping edge.

31. Apparatus according to claim 2, wherein only one of said edge members comprises said pair of transverse grooves and the other of said edge members and said elastic body extend toward the mouth of the recess only as far as the first of said pair of transverse grooves in said elongated portion.

32. Apparatus according to claim 31, wherein the stopping edge is located in the tooth and the other of said edge members faces a cleat defined by the tooth, the cleat terminating at the mouth of the recess in position to permit said elongated portion to extend at least partially through the mouth of the recess.

33. Apparatus according to claim 10, wherein said apparatus is configured to be inserted through the mouth of the recess after the tooth has been installed in the holder.

34. Apparatus according to claim 33, wherein only one of said edge members comprises said pair of transverse grooves and the other of said edge members extends at least partially over said elongated portion to limit the movement of said elongated portion during buckling.

35. Apparatus according to claim 33, wherein only one of said edge members comprises said pair of transverse grooves, said one edge member having an inner end facing the inner stopping edge; and the other of said edge members extends beyond said inner end of said one edge member at least when said one edge member is not subjected to a load to induce buckling.

36. Apparatus according to claim 33, wherein said edge members and said elastic body define a wedge shaped unit which tapers toward the inner stopping edge.

37. Apparatus according to claim 33, wherein only one of said edge members comprises said pair of transverse grooves and the other of said edge members and said elastic body extend toward the mouth of the recess only as far as the first of said pair of transverse grooves in said elongated portion.

38. Apparatus according to claim 37, wherein the stopping edge is located in the tooth and the other of said edge members faces a cleat defined by the tooth, the cleat terminating at the mouth of the recess in position to permit said elongated portion to extend at least partially through the mouth of the recess.

39. Apparatus according to claim 1, wherein said edge members and said elastic body define a wedge shaped unit which tapers toward the inner stopping edge.

40. Apparatus according to claim 1, wherein said elastic body and said edge members define a unit insertable through the mouth of the recess defined between the tooth and the holder.

* * * * *